United States Patent [19]

Monbaliu et al.

[11] Patent Number: 4,822,729

[45] Date of Patent: Apr. 18, 1989

[54] 2,5-DIACYLAMINOPHENOL-TYPE COLOR COUPLERS AND PHOTOGRAPHIC ELEMENTS CONTAINING SAME

[75] Inventors: Marcel J. Monbaliu, Mortsel; Paul L. Van Meerbeeck, Hulshout, both of Belgium

[73] Assignee: AGFA-Gevaert, N.V., Mortsel, Belgium

[21] Appl. No.: 124,609

[22] Filed: Nov. 24, 1987

[30] Foreign Application Priority Data

Dec. 5, 1986 [EP] European Pat. Off. ... EP 86202202.7

[51] Int. Cl.[4] ..... G03C 1/76; G03C 1/40

[52] U.S. Cl. ..... 430/552; 430/505; 430/553; 558/415; 558/417; 560/34; 560/45; 564/51; 564/52; 564/54; 564/55; 564/153

[58] Field of Search ..... 430/552, 553, 505; 558/415, 417; 564/51, 52, 54, 55, 153; 560/34, 45

[56] References Cited

U.S. PATENT DOCUMENTS

| | | | |
|---|---|---|---|
| 2,698,794 | 4/1950 | Godowsky | 430/550 |
| 4,334,011 | 1/1982 | Aoki et al. | 430/552 |
| 4,341,864 | 7/1982 | Vandewalle et al. | 430/552 |
| 4,362,810 | 12/1982 | Usagawa et al. | 430/553 |
| 4,717,647 | 1/1988 | Abe et al. | 430/553 |
| 4,725,530 | 2/1988 | Kobayashi et al. | 430/553 |

*Primary Examiner*—Mukund J. Shah

*Attorney, Agent, or Firm*—A. W. Breiner

[57] ABSTRACT

Cyan-forming color couplers according to the formula:

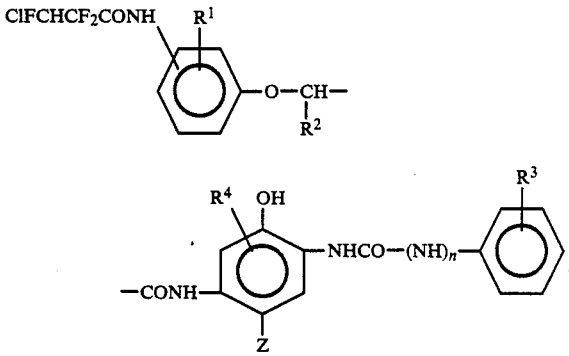

wherein Z is hydrogen or a coupling off group, $R^1$ is hydrogen, a halogen atom, alkyl, or alkoxy, $R^2$ is hydrogen or alkyl, $R_3$ is hydrogen, a halogen atom, alkyl, alkoxy, alkylsulphonyl, alkanamidosulphonyl, alkoxycarbonyl, alkanamidocarbonyl, alkanamido, alkylsulphonamido, or cyano, $R^4$ is a substituent standing at the 3- or 6-position of the phenol and selected from hydrogen, a halogen atom, and alkyl, and n is 0 or 1. These couplers can be incorporated into (a) red-sensitized silver halide emulsion layer(s) of a photographic multilayer color element or in a non-light-sensitive colloid layer in water-permeable relationship with the red-sensitized emulsion layer(s).

7 Claims, No Drawings

2,5-DIACYLAMINOPHENOL-TYPE COLOR COUPLERS AND PHOTOGRAPHIC ELEMENTS CONTAINING SAME

DESCRIPTION

The present invention relates to novel cyan-forming colour couplers, to the use thereof in the production of photographic colour images, and to photographic multilayer elements containing such colour couplers.

It is known that for the production of a photographic colour image in a light-sensitive silver halide layer, the exposed silver halide is developed to a silver image by means of an aromatic primary amino compound in the presence of a colour coupler, which enters into reaction with oxidized developing agent to form a dye at the areas corresponding to the silver image.

In subtractive three-colour photography use is made of a light-sensitive photographic colour element comprising (a) red-sensitized silver halide emulsion layer(s), (a) green-sensitized silver halide emulsion layer(s), and (a) blue-sensitive silver halide emulsion layer(s), wherein upon colour development, by the use of appropriate colour couplers, cyan, magenta, and yellow dye images are formed respectively.

Although colour photography has undergone much improvement since the appearance of the use of coupler compounds for the formation of dye images, the stability of the latter is often still insufficient. For instance, in U.S. Pat. No. 4,341,864 couplers of the 2,5-diacylaminophenol-type have been described, which in the 2-position of rthe phenol carry a 3-chloro-2,2,3-trifluoropropionamido group. Although couplers of this class have a satisfactory coupling activity, the dye images obtained therefrom were found to be susceptible to fading during storage in the absence of light.

The struggle against the tendency of dyes to fade in the dark, usually called dark-fading tendency, has intensified in recent time.

According to the present invention it has been found now that novel 2,5-diacylaminophenol couplers have a very good coupling activity and at the same time yield dyes that have an excellent stability against dark-fading.

The present invention provides novel 2,5-diacylaminophenol-type colour couplers carrying a 3-chloro-2,2,3-trifluoropropionamido group, said couplers being capable of forming a cyan indoaniline dye by reaction with an oxidized aromatic primary amino developing agent, wherein said 3-chloro-2,2,3-trifluoropropionamido group makes part of the acylamino substituent standing in the 5-position of the phenol.

More particularly, in accordance with the present invention there are provided novel cyan-forming colour couplers corresponding to the following general formula:

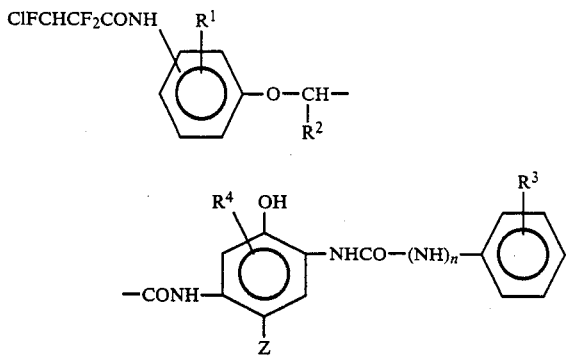

wherein represent:

Z hydrogen in the case of a 4-equivalent coupler or a so-called coupling off group, which splits off upon colour development, thus conferring to the colour coupler a 2-equivalent character e.g. a halogen atom such as chlorine, an acyloxy group, an alkoxy group, an aryloxy group, a heterocycloxy group, an alkylthio group, an arylthio group e.g. phenylthio and carboxyphenylthio, an alkylsulphonyl group, an arylsulphonyl group, an alkylsulphinyl group, an arylsulphinyl group, an alkyl- or aryl-substituted carbonylmethoxy group, an alkoxy- or aryloxy-substituted carbonylmethoxy group, a heterocyclic thio group such as a tetrazolylthio group, or a phenylazo group $R^1$ hydrogen, a halogen atom, a straight chain or branched chain $C_1$–$C_{20}$ alkyl group e.g. 4-(1,1,3,3-tetramethylbutyl), or a $C_1$–$C_{20}$ alkoxy group.

$R^2$ hydrogen or a straight chain or branched chain $C_1$–$C_{20}$ alkyl group e.g. ethyl and n-dodecyl, $R_3$ hydrogen, a halogen atom e.g. chlorine, an alkyl group e.g. tert-butyl, an alkoxy group, an alkylsulphonyl group e.g. n-propylsulphonyl, an alkanamidosulphonyl group, an alkoxycarbonyl group, an alkanamidocarbonyl group, an alkanamido group, an alkylsulphonamido group, or a cyano group, $R^4$ a substituent standing at the 3- or 6-position of the phenol and selected from the group consisting of hydrogen, a halogen atom e.g. 6-chloro, and an alkyl group, and n 0 or 1.

The present invention also provides a photographic colour element comprising at least three silver halide emulsion layers, which have been differently sensitized spectrally and wherein the novel colour coupler(s) as set forth above is (are) present in (a) red-sensitized silver halide emulsion layer(s) or in (a) non-light-sensitive colloid layer(s) in water-permeable relationship therewith.

Representative examples of novel cyan-forming colour couplers corresponding to the above general formula are given in the following Table 1. It is, however, to be understood that the invention is not limited to the colour couplers specifically listed therein.

TABLE 1

| Coupler | Position of ClFCHCF2CONH— | R1 | R2 | R3 | R4 | Z | n | Melting at °C. |
|---|---|---|---|---|---|---|---|---|
| 1 | 4- | H | n-dodecyl | H | H | Cl | 0 | 158 |
| 2 | 3- | H | n-dodecyl | H | H | Cl | 0 | 148 |
| 3 | 4- | H | n-dodecyl | 4-t.butyl | H | Cl | 0 | 130 |
| 4 | 4- | H | n-dodecyl | 2-Cl | H | Cl | 0 | 150 |

TABLE 1-continued

| Coupler | Position of ClFCHCF$_2$CONH— | $R^1$ | $R^2$ | $R^3$ | $R^4$ | Z | n | Melting at °C. |
|---|---|---|---|---|---|---|---|---|
| 5 | 2- | * | ethyl | H | H | H | 0 | 158 |
| 6 | 4- | H | n-dodecyl | H | 6-Cl | Cl | 0 | 127 |
| 7 | 2- | H | n-dodecyl | H | H | Cl | 0 | 134 |
| 8 | 4- | H | n-dodecyl | 4-Cl | H | H | 1 | 138 |
| 9 | 4- | H | n-dodecyl | H | H | H | 0 | 176 |
| 10 | 3- | H | n-dodecyl | H | H | H | 0 | 143 |
| 11 | 2- | H | n-dodecyl | H | H | H | 0 | 144 |
| 12 | 4- | H | n-dodecyl | H | H | methoxy | 0 | 110 |
| 13 | 2- | H | n-dodecyl | 4-Cl | H | H | 1 | 153 |
| 14 | 4- | H | n-dodecyl | ** | H | H | 1 | 110 |
| 15 | 2- | H | n-dodecyl | ** | H | H | 1 | 174 |

*stands for 4-(1,1,3,3-tetramethylbutyl)
**stands for 4-propylsulphonyl

The couplers 1 to 15 can be synthesized according to two alternative reaction sequences as is illustrated by the two preparation examples described hereinafter. The synthesis of the other couplers of Table 1 as well as of other couplers corresponding to the above general formula but not specifically identified herein can be derived from these preparation examples and will not cause difficulties to those skilled in the art of preparative organic chemistry.

PREPARATION 1

Coupler 2

(a)

2-(m-nitrophenoxy)-myristic acid ethyl ester

A mixture of 250 g (1.79 mol) of m-nitrophenol, 602 g (1.79 mol) of Alphabromo-myristic acid ethyl ester, 248 g (1.79 mol) of potassium carbonate, and 1350 ml of dimethylformamide is heated to 80° C. for 3 h with stirring. The mixture is then poured out slowly into a mixture of 2300 ml of water and 250 ml of acetic acid. The product is extracted with dichloromethane. The solvent is removed by evaporation.

Yield: 709 g (95%) of 2-(m-nitrophenoxy)-myristic acid ethyl ester (brown oil).

(b)

2-(m-aminophenoxy)-myristic acid ethyl ester

A solution of 154 g (0.39 mol) of 2-(m-nitrophenoxy)-myristic acid ethyl ester in 500 ml of ethanol is placed in an autoclave. An amount of 8 ml of Raney nickel is added. Reduction of the nitro group is carried out with hydrogen gas at an initial pressure of 10–10.5 MPa and a temperature of 65° C. After the reduction (2 h) the solvent is removed by evaporation.

Yield: 140 g of 2-(m-aminophenoxy)-myristic acid ethyl ester.

(c)

2-[m-(3-chloro-2,2,3-trifluoro-propionamido)-phenoxy]-myristic acid ethyl ester

An amount of 63.35 g (0.35 mol) of 3-chloro-2,2,3-trifluoro-propionyl chloride is added dropwise in 30 min to a solution of 109 g (0.3 mol) of 2-(m-aminophenoxy)-myristic acid ethyl ester in 450 ml of dichloromethane and 48 ml of pyridine. A slight reflux is observed. The mixture is then refluxed for 2 h. Subsequently, the reaction mixture is washed first with 1N hydrochloric acid and next with water until neutral. The solvent is removed by evaporation.

Yield: 139 g of 2-[m-(3-chloro-2,2,3-trifluoro-propionamido)-phenoxy]myristic acid ethyl ester (brown oil).

(d)

2-[m-(3-chloro-2,2,3-trifluoro-propionamido)-phenoxy]-myristic acid

An amount of 76.2 g (0.15 mol) of 2-[m-(3-chloro-2,2,3-trifluoropropionamido)-phenoxy]-myristic acid ethyl ester is dissolved in a mixture of 300 ml of acetic acid and 37.5 ml of 40% aqueous hydrobromic acid. The reaction mixture is heated for 15 min at 100° C., next poured out in 500 ml of methylene chloride, and finally extracted with methylene chloride. The extract is rinsed with water until neutral, dried over magnesium sulphate, and heated to remove any remaining solvent by evaporation.

Yield: 31.5 g of 2-[m-(3-chloro-2,2,3-trifluoro-propionamido)-phenoxy]-myristic acid melting at 71° C.

(e)

2-[m-(3-chloro-2,2,3-trifluoro-propionamido)-phenoxy]-myristoyl chloride

An amount of 31.5 g of 2-[m-(3-chloro-2,2,3-trifluoro-propionamido)-phenoxy]-myristic acid is refluxed for 30 min with thionyl chloride. The excess thionyl chloride is removed by evaporation. The oil obtained slowly solidifies.

Yield: 34 g of 2-[m-(3-chloro-2,2,3-trifluoro-propionamido)-phenoxy]-myristoyl chloride melting at 52° C.

(f)

Coupler 2

A solution of 16 g (0.033 mol) of 2-[m-(3-chloro-2,2,3-trifluoropropionamido)-phenoxy]-myristoyl chloride in 50 ml of dichloromethane is added dropwise in 30 min to a cooled solution of 7.90 g (0.03 mol) of 2-benzamido-4-chloro-5-aminophenol and 4.8 ml of quinoline in 100 ml of dichloromethane. The temperature of the reaction mixture is maintained between 0° and 5° C. for 1 h. The reaction mixture is first washed with 1N hydrochloric acid and next with water until neutral. The product is dried over magnesium sulphate and heated to remove any remaining solvent by evaporation. The resulting oil is purified chromatographically and recrystallized from acetonitrile.

Yield: 13 g (60%) of Coupler 1 melting at 148° C.

According to an alternative sequence of reaction steps Coupler 1 is synthesized as described in Preparation 2.

PREPARATION 2

Coupler 1

(a)

2-(p-nitrophenoxy)-myristic acid

A mixture of 980 g of 2-(p-nitrophenoxy)-myristic acid ethyl ester (synthesized analogously to the 2-(m-nitrophenoxy)-myristic acid ethyl ester of Preparation 1), 375 ml of 10N sodium hydroxide, and 1500 ml of ethanol is stirred for 1 h at room temperature and next acidified with 5000 ml of 1N hydrochloric acid. The resulting precipitate is filtered off, rinsed with water until neutral, and dried. The product (845 g) was recrystallized from n-hexane.

Yield: 732 g (80%) of 2-(p-nitrophenoxy)-myristic acid melting at 85° C.

(b)

2-(p-nitrophenoxy]-myristoyl chloride

An amount of 550 g of 2-(p-nitrophenoxy)-myristic acid is heated together with 550 ml of thionyl chloride for 1 h to 60° C. so that a solution is obtained. The excess thionyl chloride is filtered off. Yield: 585 g (100%) of 2-(p-nitrophenoxyl]-myristoyl chloride (oil).

(c)

2-benzamido-4-chloro-5-[2-(p-nitrophenoxy]-myristamido]-phenol

An amount of 843 g (2.1 mol) of 2-(p-nitrophenoxy]-myristoyl chloride is added dropwise in 60 min to a cooled (0°-5° C.) solution of 525 g (2 mol) of 2-benzamido-4-chloro-5-aminophenol in 6 l of tetrahydrofuran and 220 ml of quninoline. The temperature of the reaction mixture is kept below 10° C. The precipitate of quinoline hydrochloride is filtered off. The filtrate is concentrated by evaporation. The residual oil is poured out in 5 l of hot (50° C.) acetonitrile. Upon cooling to 5° C. a precipitate forms, whch is filtered, dried, and recrystallized from boiling isopropyl ether.

Yield: 1964 g (80%) of 2-benzamido-4-chloro-5-[2-(p-nitrophenoxy]-myristamido]-phenol melting at 121° C.

(d)

2-benzamido-4-chloro-5-[2-(p-aminophenoxy]-myristamido]-phenol

An amount of 670 g (1.10 mol) of 2-benzamido-4-chloro-5-[2-(p-nitrophenoxy]-myristamido]-phenol in the presence of 2370 ml of tetrahydrofuran, 47.8 g of morpholine, and 22 ml of Raney nickel is reduced in an autoclave at an initial hydrogen pressure of 10 MPa and a temperature of 40° C. After 90 min the theoretical amount of hydrogen is found to be taken up. The catalyst is filtered off. The filtrate is concentrated by evaporation to a volume of 1 l and then poured out in 4 l of ethanol. The precipitate is filtered off and dried.

Yield: 1072 g (89%) of 2-benzamido-4-chloro-5-[2-(p-aminophenoxy]-myristamido]-phenol melting at 134° C.

(e)

Coupler 1

A first solution of 145 g (0.25 mol) of 2-benzamido-4-chloro-5-[2-(p-aminophenoxy]-myristamido]-phenol in 1000 ml of tetrahydrofuran and 35.7 ml (0.30 mol) of quinoline is cooled to 0° C. A solution of 33 ml (0.28 mol) of 3-chloro-2,2,3-trifluoro-propionyl chloride in 100 ml of tetrahydrofuran is added to the first solution in 1 h. The temperature of the resulting mixture is maintained below 5° C. by cooling. The resulting suspension is stirred for 30 min, acidified with 100 ml of 5N hydrochloric acid, and diluted with 3 l of water. The product is extracted with dichloromethane, dried, and heated to remove any remaining solvent by evaporation. The oil obtained (185 g) is dissolved in 1 l of acetonitrile. After a few hours the end product has settled.

Yield: 144 g (79%) of Coupler 1 melting at 158° C.

The cyan-forming colour couplers according to the present invention are of the non-diffusing type and therefore comprise in their molecule an organic group sufficiently large to prevent the colour coupler from wandering from the colloid layer, in which the colour coupler has been incorporated, to another colloid layer.

In the preparation of a photographic multilayer colour element the non-diffusing colour couplers needed for forming each of the colour separation images are usually incorporated into the coating compositions of the differently sensitized silver halide emulsion layers. Yet, the non-diffusing colour couplers can also be added to the coating compositions of non-light-sensitive colloid layers that are in water-permeable relationship with the light-sensitive silver halide emulsion layers.

During the preparation of the light-sensitive colour element the non-diffusing cyan-forming colour coupler according to the above general formula can be incorporated into the coating composition of the silver halide emulsion layers or other colloid layers in water-permeable relationship therewith according to any technique known by those skilled in the art for incorporating photographic ingredients, more particularly colour couplers, into colloid compositions.

The cyan-forming colour couplers according to the invention can be dispersed, occasionally in the presence of a wetting or dispersing agent, in a hydrophilic composition constituting or forming part of the binding agent of the colloid layer. Very suitable wetting agents that can be used to disperse the cyan-forming colour couplers of the invention are the fluorine-containing surface active agents. For more details about particularly suitable techniques that can be employed for incorporating the colour couplers of the invention into a hydrophilic colloid layer of a photographic element there can be referred to GB-A Nos. 791,219-1,098,594-1,099,414-1,099,415-1,099,416-1,099,-417-1,199,570-1,218,190-1,297,947, to U.S. Pat. Nos. 2,269,158-2,304,939-2,304,940-2,322,027, to FR-A No. 1,555,663, and BE-A No. 722,026.

Another technique for incorporating colour couplers is via polymeric latices as described in DE-A Nos. 2,541,230 and 2,451,274 and as referred to hereinfore.

The cyan-forming colour couplers according to the invention can be used in conjunction with various kinds of photographic emulsions. Various silver salts can be used as the light-sensitive salt. For instance silver bromide, silver iodide, silver chloride or mixed silver halides such as silver chlorobromide, silver bromoiodide, and silver chlorobromoiodide can be employed. The couplers can be used in emulsions of the mixed packet type as described in the U.S. Pat. No. 2,698,794 or emulsions of the mixed grain type as described in the U.S. Pat. No. 2,592,243. The colour couplers can be used with emulsions wherein latent images are formed predominantly at the surface of the silver halide crystal or with emulsions wherein latent images are formed predominantly inside the silver halide crystal.

The hydrophilic colloid used as the vehicle for the silver halide can be e.g. gelatin, colloidal albumin, zein, casein, a cellulose derivative, a synthetic hydrophilic colloid such as polyvinyl alcohol or poly-N-vinyl pyrrolidone. If desired, compatible mixtures of two or more of these colloids can be employed for dispersing the silver halide.

The light-sensitive silver halide emulsions used in the preparation of a photographic material according to the present invention can be sensitized chemically as well as spectrally. They can be sensitized chemically by carrying out the ripening in the presence of small amounts of sulphur-containing compounds such as allyl thiocyanate, allyl thiourea, or sodium thiosulphate. The emulsions can also be sensitized by means of reducing agents e.g. tin compounds as described in FR-A No. 1,146,955 and in BE-A No. 568,687, imino-aminomethane sulphinic acid compounds as described in GB-A No. 789,823 and small amounts of noble metal compounds such as gold, platinum, palladium, iridium, ruthenium, and rhodium compounds. They can be sensitized spectrally by means of cyanine and merocyanine dyes.

The said emulsions can also comprise compounds that sensitize the emulsions by development acceleration e.g. compounds of the polyoxyalkylene type such as alkylene oxide condensation products as described i.a. in U.S. Pat. Nos. 2,531,831-2,533,990 in GB-A Nos. 920,637-940,051-945,340-991,608 and 1,091,705, and onium derivatives of amino-N-oxides as described in GB-A No. 1,121,696.

Further, the emulsions may comprise stabilizers e.g. heterocyclic nitrogen-containing thioxo compounds such as benzothiazoline-2-thione and 1-phenyl-2-tetrazoline-5-thione and compounds of the hydroxytriazolopyrimidine type. They can also be stabilized with mercury compounds such as the mercury compound described in BE-A Nos. 524,121 and 677,337, and in GB-A No. 1,173,609.

The light-sensitive emulsions containing the colour couplers of the invention may also comprise any other kind of ingredient such as those described for such emulsions in Research Disclosure No. 17,643 of December 1978, in particular development-inhibitor-releasing compounds and competing couplers. Such compounds and couplers can be incorporated in layers in water-permeable relationship with the emulsion layers containing the couplers of the present invention.

The non-diffusing cyan-forming colour couplers of the present invention are usually incorporated into a red-sensitive silver halide emulsion for forming one of the differently sensitized silver halide emulsion layers of a photographic multilayer colour element. Such photographic multilayer colour element usually comprises a support, (a) red-sensitized silver halide emulsion layer(s) with cyan-forming colour coupler, (a) green-sensitized silver halide emulsion layer(s) with (a) magenta-forming colour coupler, and (a) blue-sensitive silver halide emulsion layer(s) with (a) yellow-forming colour coupler.

The emulsions can be coated on a wide variety of photographic emulsion supports. Typical supports include cellulose ester film, polyvinylacetal film polystyrene film polyethylene terephthalate film and related films or resinous materials, as well as glass and paper e.g. polyethylene-coated paper.

For the production of photographic colour images according to the present invention an exposed silver halide emulsion layer is developed with an aromatic primary amino developing substance in the presence of a colour coupler according to the present invention. All colour developing agents capable of forming azomethine dyes can be utilized as developers. Suitable developing agents are aromatic compounds in particular p-phenylene diamines e.g. N,N-diethyl-p-phenylene diamine, N,N-dialkyl-N'-sulphomethyl-p-phenylene diamines and N,N-dialkyl-N'-carboxymethyl-p-phenylene diamines.

The following examples illustrate the present invention.

EXAMPLE 1

114.6 g of a red-sensitized silver bromoiodide emulsion (2.3 mole % of iodide) comprising per kg an amount of 73.4 g of gelatin and an amount of silver halide equivalent to 47 g of silver nitrate were diluted with 127 g of a 7.5% by volume solution of gelatin in 100 ml of distilled water.

A dispersion of cyan-forming colour coupler was made by dissolving 0.006 mole of the colour coupler as specified in Table 2 hereinafter in 16 ml of ethyl acetate and 2 g of dibutyl phthalate, dispersing the resulting solution in 100 ml of a 5% by volume aqueous solution of gelatin containing 0.4 g of the sodium salt of dodecylbenzene sulphonic acid by means of an ultrasonic power generator, and eliminating the ethyl acetate by evaporation under reduced pressure.

The resulting dispersion was added to the red-sensitive silver halide emulsion.

After neutralization of the emulsion and addition thereto of the ususal additives such as stabilizing agents e.g. 5-methyl-7-hydroxy-s-triazolo-[1,5-a]-pyrimidine, wetting agents, and hardening agents the necessary amount of distilled water to obtain 575 g of emulsion was added.

The emulsion was coated on a film support in a ratio of 150 g per m2. The emulsion layer was dried and covered with a gelatin antistress layer. The dried emulsion material was cut in two and the resulting strips were exposed in a Herrnfeld sensitometer for 1/20th second through a continuous wedge with a constant of 0.30. The exposed strips were colour-developed, bleached, fixed and washed in the conventional way using two different types of common developers viz.

the first developer containing as developing agent 2-amino-5-diethylamino-toluene hydrochloride; development time: 10 min; temperature of development: 24° C.;

the second developer containing as developing agent 4-amino-N-ethyl-N-(Beta-methanesulphonamidoethyl)-m-toluidine sesquisulphate monohydrate; development time: 15 min; temperature of development: 21° C.

In Table 2 hereinafter the values of speed, gradation, and maximum density obtained after processing with the above-mentioned 2 developers of the strips of red-sensitized emulsion containing the cyan-forming couplers are given.

The speed was measured at 0.2 above fog. The values given for the speed are relative values, a value of 100 being given to the emulsion containing the comparison coupler A and a value of 200 corresponding to a doubling of the speed.

The comparison coupler A is coupler 1 of Table 1 in U.S. Pat. No. 4,341,864, comparison coupler B is coupler 9, and comparison coupler C is coupler 4, also both listed in Table 1 of U.S. Pat. No. 4,341,864.

TABLE 2

| Coupler No | Sensitometric results speed | 1st developer gradation | Dmax | speed | 2nd developer gradation | Dmax |
|---|---|---|---|---|---|---|
| A | 100 | 1.41 | 2.73 | 100 | 1.75 | 2.70 |
| B | 110 | 2.20 | 3.00 | 102 | 1.61 | 2.61 |
| C | 110 | 2.12 | 2.89 | 100 | 1.45 | 2.54 |
| 1 | 117 | 2.58 | 3.66 | 112 | 2.00 | 3.03 |
| 2 | 117 | 2.20 | 3.41 | 112 | 1.89 | 2.83 |
| 3 | 117 | 2.23 | 3.20 | 110 | 1.80 | 2.90 |
| 4 | 120 | 2.40 | 3.61 | 112 | 1.80 | 3.00 |

It appears from the results in Table 2 that the values of speed, gradation, and maximum density of the materials containing the couplers according to the present invention (Couplers 1 to 4) are better than those of the materials containing the comparison couplers A to C.

EXAMPLE 2

Emulsion materials were made analogously as described in Example 1, exposed in a Herrnfeld sensitometer for 1/20th second through a step wedge including a step having density 1 and a step having density 1.5, and processed as described in Example 1, these emulsion materials comprising the couplers as indicated in Table 3 hereinafter.

The developed strips were stored for 192 h at 90° C. and a relative humidity of 40%.

The density was measured again and the loss of density due to dark-fading was determined.

In Table 3 the percent loss of density is given for the materials comprising the comparison couplers A, B, C, and D, which are the couplers 1, 9, 4, and 12 respectively in Table 1 of U.S. Pat. No. 4,341,864, as well as for the material comprising the couplers 1, 2, and 5 according to the present invention.

TABLE 3

| Coupler No | Dark-fading % loss of density: 1st developer Density 1 | 1st developer Density 1.5 | 2nd developer Density 1 | 2nd developer Density 1.5 |
|---|---|---|---|---|
| A | −17 | −11 | −12 | −8 |
| B | −30 | −24 | −21 | −16 |
| C | −8 | −6 | −8 | −6 |
| D | −11 | −9 | −12 | −19 |
| 1 | −3 | −2 | −3 | −2 |
| 2 | −2 | −2 | −3 | −2 |
| 5 | −0 | −1 | −1 | −2 |

It appears from the results in Table 3 that the tendency of the dyes obtained according to the present invention to fade in the dark is extremely low.

It can be concluded that thanks to the high coupling activity of the couplers according to the present invention very favourable sensitometric results are obtained and that above all the dyes obtained therewith have an excellent stability against dark-fading.

We claim:

1. 2,5-Diacylaminophenol-type colour couplers carrying a 3-chloro-2,2,3-trifluoropropionamido group, said couplers being capable of forming a cyan indoaniline dye by reaction with an oxidized aromatic primary amino developing agent, wherein said 3-chloro-2,2,3-trifluoropropionamido group makes part of the acylamino substituent standing in the 5-position of the phenol.

2. A colour coupler according to claim 1, wherein said coupler corresponds to the following general formula:

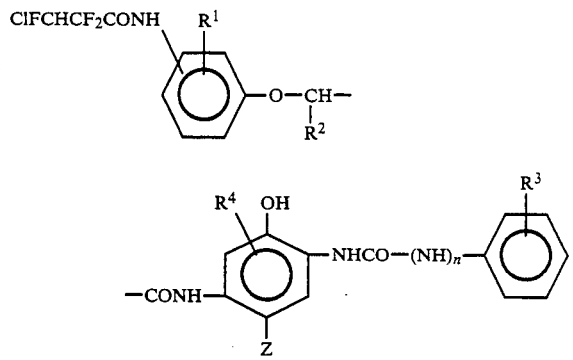

wherein represent:

Z hydrogen or a coupling off group, $R^1$ a substituent chosen from the group consisting of hydrogen, a halogen atom, a straight chain or branched chain $C_1$–$C_{20}$ alkyl group, and a $C_1$–$C_{20}$ alkoxy group, $R^2$ hydrogen or a straight chain or branched chain $C_1$–$C_{20}$ alkyl group, $R_3$ a substituent chosen from the group consisting of hydrogen, a halogen atom, an alkyl group, an alkoxy group, an alkylsulphonyl group, an alkanamidosulphonyl group, an alkoxycarbonyl group, an alkanamidocarbonyl group, an alkanamido group, an alkylsulphonamido group, and a cyano group, $R^4$ a substituent standing at the 3- or 6-position of the phenol and selected from the group consisting of hydrogen, a halogen atom, and an alkyl group, and n 0 or 1.

3. Photographic element comprising (a) light-sensitive silver halide emulsion layer(s) and at least one 2,5-diacylaminophenol-type colour coupler carrying a 3-chloro-2,2,3-trifluoropropionamido group, said coupler being capable of forming a cyan indoaniline dye by reaction with an oxidized aromatic primary amino developing agent, wherein said 3-chloro-2,2,3-trifluoropropionamido group makes part of the acylamino substituent standing in the 5-position of the phenol.

4. Photographic element according to claim 3, wherein said coupler corresponds to the following general formula:

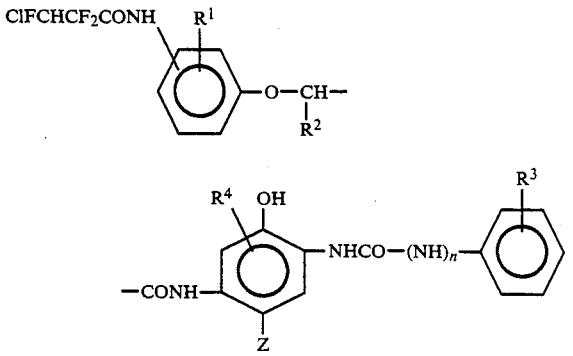

wherein represent:

Z hydrogen or a coupling off group, $R^1$ a substituent chosen from the group consisting of hydrogen, a halogen atom, a straight chain or branched chain $C_1$–$C_{20}$ alkyl group, and a $C_1$–$C_{20}$ group.

$R^2$ hydrogen or a straight chain or branched chain $C_1$–$C_{20}$ alkyl group, $R_3$ a substituent chosen from the group consisting of hydrogen, a halogen atom, an alkyl group, an alkoxy group, an aliylsulphonyl group, an alkanamidosulphonyl group, an alkoxycarbonyl group, an alkanamidocarbonyl group, an alkanamido group, an alkylsulphonamido group, and a cyano group, $R^4$ a substituent standing at the 3- or 6-position of the phenol and selected from the group consisting of hydrogen, a halogen atom, and an alkyl group, an n 0 or 1.

5. Photographic multilayer colour element comprising in one of the light-sensitive silver halide emulsion layers or in a non-light-sensitive water-permeable colloid layer in water-permeable relationship with the light-sensitive silver halide emulsion layer at least one 2,5-diacylaminophenol-type colour coupler carrying a 3-chloro-2,2,3-trifluoropropionamido group, said coupler being capable of forming a cyan indoaniline dye by reaction with an oxidized aromatic primary amino developing agent, wherein said 3-chloro-2,2,3-trifluoropropionamido group makes part of the acylamino substituent standing in the 5-position of the phenol.

6. Photographic multilayer color element according to claim 5, wherein said coupler corresponds to the following general formula:

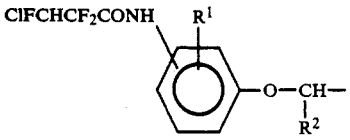

-continued

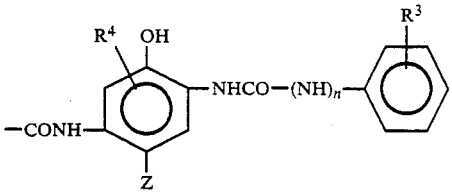

wherein represent:

Z hydrogen or a coupling off group, $R^1$ a substituent chosen from the group consisting of hydrogen, a halogen atom, a straight chain or branched chain $C_1$–$C_{20}$ alkyl group, and a $C_1$–$C_{20}$ alkoxy group, $R^2$ hydrogen or a straight chain or branched chain $C_1$–$C_{20}$ alkyl group, $R_3$ a substituent chosen from the group consisting of hydrogen, a halogen atom, an alkyl group, an alkoxy group, an alkylsulphonyl group, an alkanamidosulphonyl group, an alkoxycarbonyl group, an alkanamidocarbonyl group, an alkanamido group, an alkylsulphonamido group, and a cyano group, $R^4$ a substituent standing at the 3- or 6-position of the phenol and selected from the group consisting of hydrogen, a halogen atom, and an alkyl group, and n 0 or 1.

7. Photographic multilayer colour element comprising at least three silver halide emulsion layers, which are differently sensitized spectrally, wherein a red-sensitized silver halide emulsion layer or a non-light-sensitive colloid layer in water-permeable relationship therewith incorporates at least one 2,5-diacylaminophenol-type colour coupler carrying a 3-chloro-2,2,3-trifluoropropionamido group, said coupler being capable of forming a cyan indoaniline dye by reaction with an oxidized aromatic primary amino developing agent, and said 3-chloro-2,2,3-trifluoro-propionamido group making part of the acylamino substituent standing in the 5-position of the phenol.

* * * * *